US005371059A

United States Patent [19]

Hirano et al.

[11] Patent Number: 5,371,059

[45] Date of Patent: Dec. 6, 1994

[54] METHOD FOR REGENERATING A THERMOSENSITIVE TRANSFER RECORDING MEDIUM AND THERMOSENSITIVE TRANSFER RECORDING APPARATUS

[75] Inventors: Hideki Hirano; Kenji Shinozaki; Mari Seki, all of Kanagawa, Japan

[73] Assignee: Sony Corporation, Japan

[21] Appl. No.: 100,996

[22] Filed: Aug. 3, 1993

[30] Foreign Application Priority Data

Aug. 8, 1992 [JP] Japan ..... 4-232711

[51] Int. Cl.[5] ..... B41M 5/035; B41M 5/38

[52] U.S. Cl. ..... 503/227; 427/141; 428/195; 428/913; 428/914

[58] Field of Search ..... 8/471; 427/141; 428/195, 913, 914; 503/227

[56] References Cited

U.S. PATENT DOCUMENTS 5,292,709 3/1994 Sakamoto ..... 503/227

*Primary Examiner*—B. Hamilton Hess

*Attorney, Agent, or Firm*—Ronald P. Kananen

[57] ABSTRACT

A method and apparatus for regenerating a thermosensitive transfer recording medium 1 comprising a dye layer having a thermally diffusable dye at a concentration, wherein the medium 1 is superposed on a material 10 to be transferred and heated in an imagewise pattern to transfer the dye of the medium 1 to the material 10 to be transferred thereby forming an image. The apparatus comprises a dye supplier 4 containing a thermally diffusable dye at a concentration higher than that of the dye layer, and a heating means 7 for diffusing the dye from the supplier 4 toward the dye layer whereby the dye consumed during the transfer recording operations is supplemented from the supplier 4 to the dye layer. A thermosensitive transfer recording apparatus is also described along with a thermosensitive transfer recording medium and a dye supplier.

3 Claims, 4 Drawing Sheets

METHOD FOR REGENERATING A THERMOSENSITIVE TRANSFER RECORDING MEDIUM AND THERMOSENSITIVE TRANSFER RECORDING APPARATUS

BACKGROUND OF THE INVENTION

1. Field of the Invention

This invention relates to a method for regenerating a thermosensitive transfer recording medium wherein a thermosensitive transfer recording medium can be repeatedly used by supplement of inks to the medium. The invention also relates to a thermosensitive transfer recording medium which is adapted for carrying out the regeneration method, and also to a regeneration apparatus and a thermosensitive transfer recording apparatus.

2. Description of the Related Art

Thermosensitive transfer recording methods have been hitherto widely used wherein a material to be transferred such as a printing sheet and a thermosensitive transfer recording medium are superposed, and the medium is selectively heated according to image signals by use of heating means such as a thermal head, a laser beam or the like thereby transferring a dye from the recording medium to the material to be transferred to print the image. The thermosensitive transfer recording medium are thrown away. From the standpoints of economy and ecology, there is a social demand for regenerating the wasted thermosensitive transfer recording medium for repeated use.

The manner of improving the utilization efficiency of the recording medium may be broadly classified into two categories. One category includes a method wherein a dye layer of the medium is regenerated and repeatedly used such as in a dye layer regeneration method and in a method using a multiple mode dye layer arrangement. The other includes a method of effectively utilizing the recording medium such as a relative speed method. The dye layer regeneration method is a method wherein a thermosensitive transfer recording medium, which is used in thermosensitive transfer recording systems of the thermal fusion type (wherein a dye layer is thermally fused and transferred to a material to be transferred thereby forming an image), is regenerated for repeated used. For the regeneration, the thermosensitive transfer recording medium is arranged in the form of an endless belt and the dye layer of the recording medium which has been consumed by the transfer is re-formed by application of a thermally fusible ink such as set forth in Japanese Patent Publication Nos. 49-26245 and 59-16932. The method making use of a multiple mode dye layer arrangement is also applicable to the thermal fusion thermosensitive transfer recording systems, in which a dye layer of an ink sheet is formed by impregnating a thermally fusible ink in a porous network structure layer. By this, when the ink in the surface of the ink sheet has been consumed, the ink is exuded from the inside to the surface. This permits repeated transfer operations (Ozawa and Shimizu, National Meeting of the Electronic Communication Society, 1236(1983)). The relative speed method is a kind of thermosensitive transfer recording method using sublimable dyes wherein an ink sheet is fed at a relative speed different from that of a material to be transferred, thereby improving repeated recording properties of the ink sheet. This method allows the dye layer to be transferred several times (Taguchi et al, Journal of the Electrophotographic Society, Vol. 24, No. 3, p. 17(1985)).

Among the conventional methods of improving the utilization efficiency of the thermosensitive transfer recording medium, the dye layer regeneration method and the method using the multiple-mode dye layer arrangement have difficulties in the uniform reformation of the dye layer surface of the thermosensitive transfer recording medium. In the dye layer regeneration method, the dye is supplemented by a wet process which requires organic solvents. This will prevent the supplemental mechanism and the maintenance from being simplified. With the method using the multiple mode dye layer arrangement, any dye is not supplemented from outside to the once formed dye layer, ensuring only several times of repetitions of the recording cycle using the ink sheet. Thus, a greater number of the ink transfer cycles is not possible. This is the reason why these methods have never been put into practice. On the other hand, the the relative speed method has the problem that the mechanism for changing the relative speed between the material to be transferred and the ink sheet becomes complicated. In this method, the dye is not supplemented from outside and the ink sheet is used only in several repeated recording cycles. Thus, a greater number of transfer cycles are not possible. The relative speed method has not been reduced into practice yet.

SUMMARY OF THE INVENTION

It is accordingly an object of the invention to provide a method for regenerating a thermosensitive transfer recording medium whereby the medium can stand repeated use in great number and wherein dyes are continuously supplemented from outside to the recording medium.

It is another object of the invention to provide a thermosensitive transfer recording medium which is adapted for the regeneration thereof.

It is a further object of the invention to provide a regeneration apparatus and a thermosensitive transfer recording apparatus making use of the medium set out above.

We have found that in thermosensitive transfer recording mediums using thermally diffusable dyes such as sublimable dyes, when resin binders for a dye layer has appropriate miscibility with a dye and good diffusability of the ink, the dye in the ink layer is rapidly diffused through the dye layer on heating. In addition, when a dye feeder containing a high concentration of the dye is brought into contact with dye layer and heated, the dye is migrated from the dye feeder to the dye layer through thermal diffusion, thus permitting the dye of the dye layer consumed during the transfer operation to be supplemented while making a uniform dye concentration in the dye layer. The invention is based on this finding.

More particularly, according to one embodiment of the invention, there is provided a method for regenerating a thermosensitive transfer recording medium which comprises providing a thermosensitive transfer recording medium which comprises a dye layer containing a thermally diffusable dye at a concentration and which has been subjected to thermosensitive transfer recording so that the thermally diffusable dye is consumed during the recording, bringing the recording medium into contact with a dye supplier having a concentration of the dye higher than that of the dye layer, and diffusing the dye from the dye supplier to the dye layer by heating.

According to another embodiment of the invention, there is also provided a thermosensitive transfer recording apparatus of the type wherein a thermosensitive transfer recording medium which comprises a dye layer containing a thermally diffusable dye is superposed on a material to be transferred, and is selectively heated in an imagewise pattern to transfer the dye from the dye layer to the material to be transferred thereby forming an image, the improvement characterized by further comprising a dye supplier having a diffusable dye at a concentration higher than that of the dye layer, and a heating means for thermally diffusing the dye from the dye supplier toward the dye layer.

According to a further embodiment of the invention, there is provided an apparatus for regenerating a thermosensitive transfer recording medium which comprises means for stopping a thermosensitive transfer recording medium to be regenerated, the medium comprising a dye layer containing thermally diffusable dye, means for bringing the medium into contact with a dye supplier which contains a diffusable dye at a concentration higher than that of the dye layer, and a means for heating the contacted dye supplier to cause the dye of the supplier to be diffused from the supplier toward the dye layer.

According to a still further embodiment of the invention, there is provided a thermosensitive transfer recording medium which is adapted for carrying out the regeneration method, the medium comprising a dye layer comprised of a member selected from the group consisting of silicone resins and silicone resin derivatives and a thermally diffusable dye dispersed in the member.

The dye supplier appropriately used in the regeneration method is made of the dye and a plasticizer.

According to the invention, the thermosensitive transfer recording medium which has been subjected to thermosensitive transfer recording is continuously supplied with a dye from outside and can thus be repeatedly used a great number of times.

DETAILED DESCRIPTION OF THE PREFERRED EMBODIMENTS

The thermosensitive transfer recording medium which is effective in carrying out the regeneration method of the invention makes use of thermally diffusable dyes. The dyes should be ones which have low melting points and can be readily thermally transferred and are arbitrarily selected from disperse dyes, solvent dyes, leuco dyes, oil-solubilized acid dyes, oil-solubilized cationic dyes and the like. In addition, those dyes which ensure complete fixing of transferred images through covalent or ionic bond with polymers of the image-receiving layer of a material to be transferred. Preferably, the dyes should have good miscibility with binder resins and a great coefficient of diffusion in the binder.

The binder resins for the dyes should have appropriate miscibility with the dye and allow the dye to be satisfactorily impregnated or dispersed therein. Preferably, the resins should have good heat resistance and mechanical strength.

Examples of preferred binder resins include silicone resins and silicone resin derivatives. Silicone resins and derivatives thereof include dimethyl silicone resin, methyl phenyl silicone resins, terminal modified silicone resins, block copolymers of silicone crosslinked products and organic resins such as polyesters, polyvinyl chloride and the like. With the block copolymers of silicone resins and organic resins, if the content of the silicone resin is too small, the diffusion rate of the dye is lowered. In this sense, the content of the silicone resin should preferably be not less than 10%.

Figure 4:
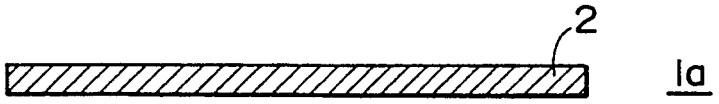
FIG. 4 is a schematic sectional view of a thermosensitive transfer recording medium according to a still further embodiment of the invention.

The thermosensitive transfer recording medium which makes use of such dyes and binder resins as set out hereinabove is so arranged as shown in FIG. 4. In the figure, there is shown a thermosensitive transfer recording medium la which consists of a single dye layer 2. The layer 2 is made of a layer of a binder resin, such as silicone resin or silicone resin derivative, in which a dye is impregnated to a saturation solubility. The layer 2 may be constituted of sub-layers of different types of silicone resins or derivatives being built up, or of a silicone resin layer and a layer of other type of organic resin being built up.

Figure 5:
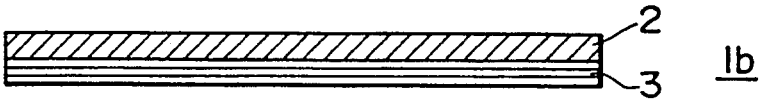
FIG. 5 is a schematic sectional view of a thermosensitive transfer recording medium according to another embodiment of the invention.
Figure 6:
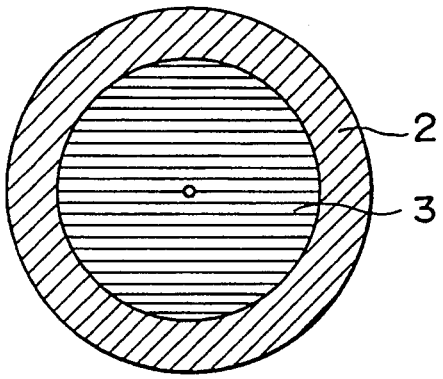
FIG. 6 is a schematic sectional view of a thermosensitive transfer recording medium according to another embodiment of the invention.
Figure 7:
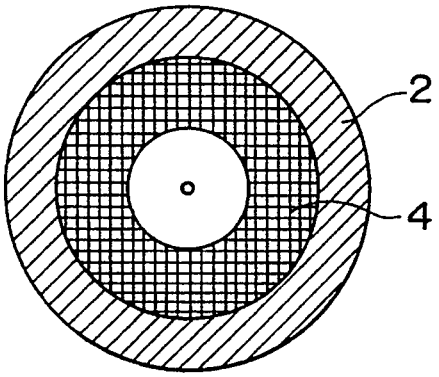
FIG. 7 is a schematic sectional view of a thermosensitive transfer recording medium and a dye supplier according to the invention.

Another embodiment is shown in FIG. 5. In the figure, there is shown a thermosensitive transfer recording medium 1*b* which has a double-layer structure including a substrate 3 and a dye layer 2 as shown in FIG. 4. In this case, the substrate 3 may be made of plastic films such as polyethylene terephthalate, polyimides and the like, paper sheets such as condenser paper, and metallic sheets. If the thermosensitive transfer recording medium is shaped in the form of sheets as shown in FIGS. 4 and 5, it may be used in the form of an endless ribbon. Aside from the above, the recording medium may be formed, as 2, on a plastic roll or metal roll substrate 3 as shown in FIG. 6. Moreover, the recording medium may be formed to cover a cylinder of a dye supplier 4 as shown in FIG. 7.

In the thermosensitive transfer recording mediums thus fabricated, the dye layer which is a kind of binder resin layer in which a dye is impregnated or dispersed is made thick, it has the buffering function of the dye. More particularly, even if a fresh dye is not supplemented for a time, the dye can be stably supplied to a material to be transferred. In this sense, a relatively thick binder resin layer should be preferred. In this connection, if the binder resin layer is formed as thick, the heat efficiency is lowered when heat is applied by heating means such as a thermal head from the side of the recording medium at the time of the thermal transfer. To cope with the problem of lowering the heat efficiency, the heat should be applied from the side of a material to be transferred. In case where the material to be transferred is heated, a thin film is employed as the material to be transferred. It is preferred that after formation of a thermally transferred image on the film, the film is laminated on a mount to obtain a final image.

The regeneration of the recording medium according to the method of the invention is then described. In the method, a dye supplier from which a dye is supplied to the recording medium should contain a dye at a concentration higher than that in the recording medium. The dye supplier may be one which consists of a dye alone or which is made of a dispersion of a highly concentrated dye in a medium, or one wherein a dye is impregnated in a porous material at a high concentration. Preferably, the dye supplier should contain plasticizers such as dichlorohexyl phthalate, surface active agents such as alkylsulfonates, and the like in order to enhance the diffusability of the dye.

On regeneration of the recording medium, the dye supplier is heated. The manner of heating is not critical. So far as the dye is migrated by diffusion from the dye supplier to the medium, a variety of methods may be used. For instance, the medium and the dye supplier may be superposed, under which they are heated by means of a heater. Under the superposed conditions, the dye supplier may be electrically heated.

Reference is now made to the accompanying drawings to illustrate examples of the invention. In the drawings, like reference numerals indicate like parts or members.

EXAMPLE 1

Figure 1:
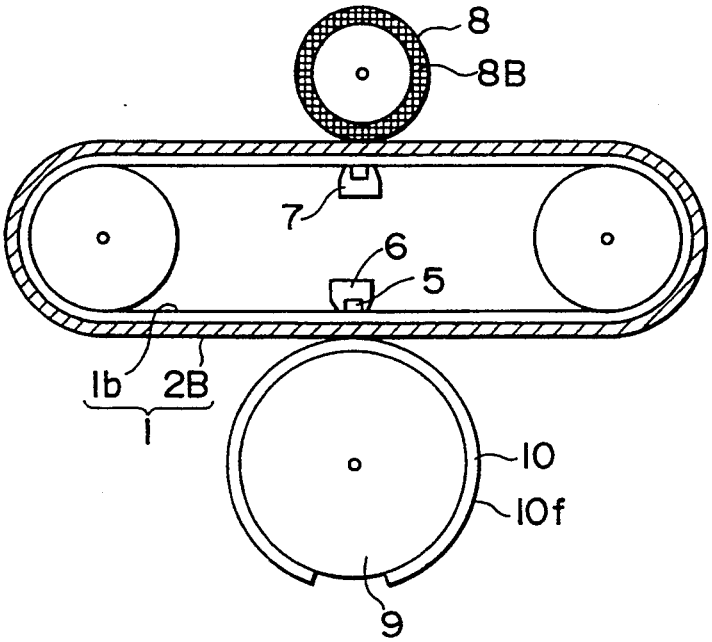
FIG. 1 is a schematic view of a thermosensitive transfer recording medium according to one embodiment of the invention.

FIG. 1 shows a thermosensitive transfer recording apparatus of the invention. In the figure, there is schematically shown an apparatus for carrying out multiple mode transfer recording for B/W. The apparatus has, as a heating means, a thermal head 6 having a heating element 5 arranged in a matrix form. On the other hand, a heating means for supplementing a dye is a heater 7. A thermosensitive transfer recording medium 1 is in the form of an endless belt which includes a 6 μm thick PET film whose back side 1*b* has been subjected to heat-resistant treatment, and a dye layer 2B. The dye layer 2B is formed by applying a polyester-modified methyl phenyl silicone resin (PH11, Toray-Dow Corning Silicone Co., Ltd.), in which a black dye has been dissolved to a saturation, in a dry thickness of 5 μm and curing the applied resin. As a dye supplier, an ink stick 8 is attached for supplying a dye. The ink stick 8 is in the form of a cylinder and has a dye layer 8B which is made of a 5 mm thick porous polyethylene foamed sheet held with a black dye therein at a high concentration. A platen roll 9 is provided in contact with the endless belt and has a printing sheet 10 wound therearound. The sheet 10 has a polyester image-receiving layer 10*f* on the surface thereof.

In operation, the printing sheet 10 and the recording medium 1 are brought into contact with each other. In this state, the medium 1 is heated by means of the thermal head 5 in an imagewise pattern to form a B/W image on the image-receiving layer of the printing sheet 10. The resultant image had an optical density of 2 when determined by the Macbeth densitometer.

After completion of the recording, the recording medium 1 whose dye concentration is partially lowered is regenerated in the following manner.

The dye layer 2B of the medium 1 is contacted with the ink stick 8 and heated by means of the heater 7 at about 100° C. for several tens milli-seconds. As a consequence, the dye is diffused from the dye layer 8B of the ink stick 8 toward the dye layer 2B of the medium 1 to an extent that the dye concentrations become equibrated between the dye layer 8B and the dye layer 2B, thereby regenerating the medium 1.

The transfer recording procedure and the regeneration procedure are repeated, whereupon it has been found that the dye concentration in the dye layer 2B of the medium is maintained constant, without involving any lowering of the transfer sensitivity.

EXAMPLE 2

Figure 2:
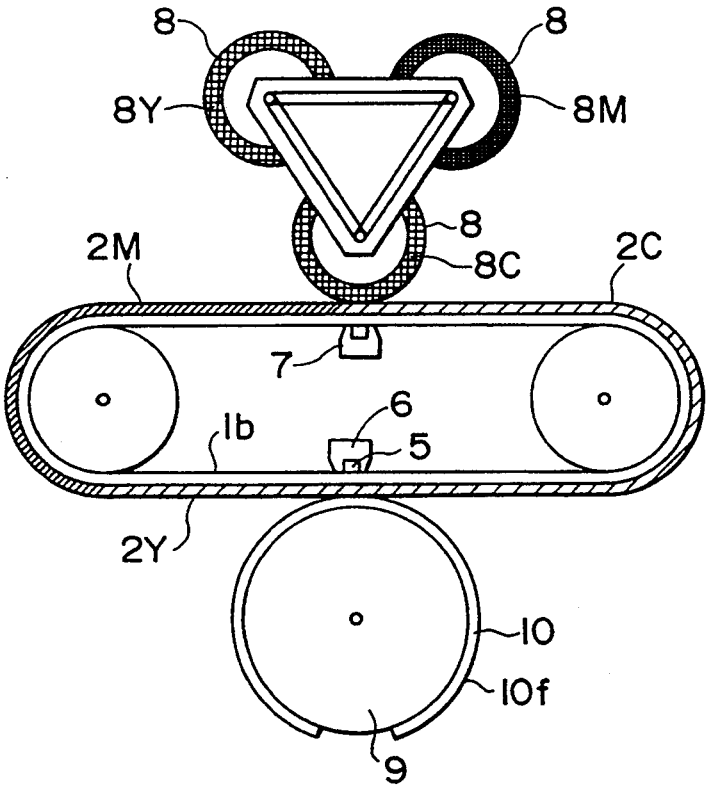
FIG. 2 is a schematic view of a thermosensitive transfer recording medium according to another embodiment of the invention.

FIG. 2 schematically shows another embodiment of a thermosensitive transfer recording apparatus of the invention, which is suitable for full color multiple-mode transfer recording. The apparatus has also the thermal head 6 having the heating element 5 and the heater 7 for supplementing a dye. The thermosensitive transfer recording medium 1 is similar to that of Example 1 and includes the 6 μm thick PET film whose back side has been subjected to heat-resistant treatment, and the dye layer formed on the opposite side of the PET film. The dye layer is formed by applying a polyester-modified methylphenyl silicone resin (PH-11, available from Toray-Dow Corning Silicone Co., Ltd.), in which dyes have been, respectively, dissolved to a saturation, in a dry thickness of 5 μm, and curing to form the dye layer. The dye layer is divided into three sections 2Y, 2M and 2C in the running direction of the film. A yellow dye (ESC-155, available from Sumitomo Chem. Co., Ltd.), a magenta dye (ESC-451, available from Sumitomo Chem. Co., Ltd.), and a cyan dye (Foron Blue, available from Sandoz Co., Ltd.) are, respectively, used in the sections 2Y, 2M and 2C. Dye suppliers are made of three ink sticks 8 having, respectively, dye layers 8Y, 8M and 8C which are formed of yellow, magenta and cyan dyes, to which 10% of dicyclohexyl phthalate is, respectively, added. Each dye layer has a thickness of 5 mm.

In operation, the printing sheet 10 and the yellow dye layer 2Y of the medium 1 are superposed and heated from the side of the medium 1 by means of the thermal head 6 to effect the thermosensitive transfer recording. Thereafter, the medium 1 is moved, followed by thermosensitive transfer recording using the magenta dye layer 2M and the cyan dye layer 2C on the sheet 10, successively, thereby obtaining a full color image. The thus obtained image had an optical density of 2 for all the yellow, magenta and cyan colors when determined by use of the Macbeth densitometer.

After completion of the recording, the medium 1 whose concentrations of the respective dyes are partially lowered are regenerated in the following manner. The yellow dye layer 2Y of the medium 1 is contacted with the yellow dye layer 8Y of the ink stick and heated by means of the heater 7 for several tens milli-seconds. As a result, the yellow dye is allowed to diffuse from the yellow dye layer 8Y of the ink stick toward the dye layer 2Y of the medium 1, thereby regenerating the yellow dye layer 2 of the medium 1. Likewise, the magenta dye layer 2M and the cyan dye layer 2C of the medium are, respectively, contacted with the dye layers of 8M and 8C of the ink stick and heated for regeneration.

It has been found that when the thermosensitive transfer recording and regeneration procedures set out above are repeated, the dye concentrations in the respective dye layers of the medium are maintained constant without lowering the thermal sensitivity.

Comparative Example 1

The general procedure of Example 2 is repeated using, as the binder resin for the dye layer of the medium, a polyvinyl butyral resin in place of the polyester-modified methyl phenyl silicone resin, thereby making a thermosensitive transfer recording medium. The medium s subjected to the thermosensitive transfer recording and the regeneration of the medium. As a result, it has been found that when the regeneration of the medium is continued for several tens milli-seconds, the dyes cannot be sufficiently diffused from the dye layers of the ink stick toward the respective dye layers of the medium. Thus, the transfer sensitivity becomes lower whenever the number of the transfer recording cycles is increased.

EXAMPLE 3

Figure 3:
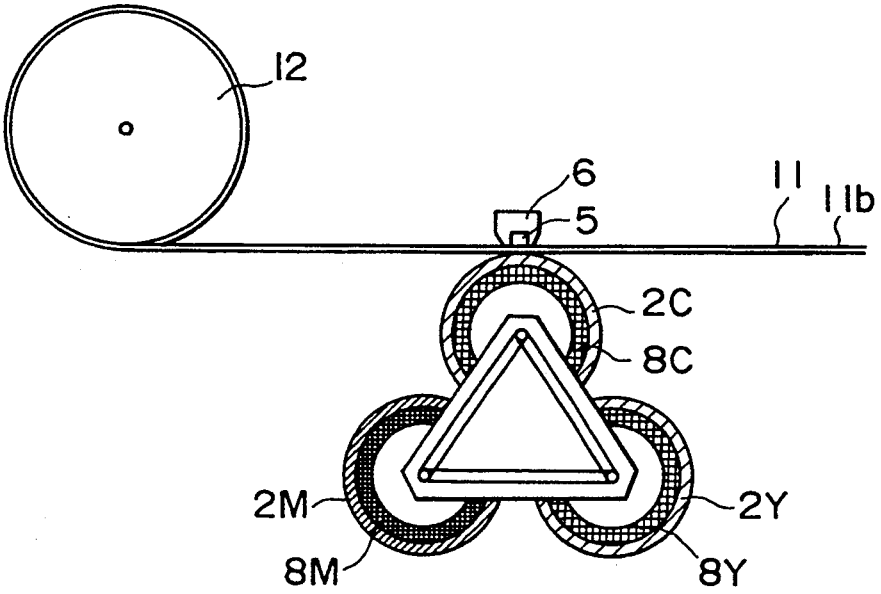
FIG. 3 is a schematic view of a thermosensitive transfer recording medium according to a further embodiment of the invention.

FIG. 3 schematically shows a further embodiment of a thermosensitive transfer recording apparatus of the invention which makes use of a thin printing film 11 as a material to be transferred so that the thermosensitive transfer recording is effected by heating from the side of the material to be transferred. The apparatus has the thermal head 6 having the heating element 5 which is so provided as to heat from the side of the printing film 11. Similar dyes as used in Example 2 are,respectively, dissolved in dimethyl silicone rubber and applied onto dye feeding cylinders 8Y, 8M and 8C to form dye layers 2Y, 2M and 2C each in a dry thickness of 500 μm. Carbon black is added to these dimethyl silicone rubber layers so that electric conductivity is imparted thereto. Of course, electrodes (not shown) are provided appropriately on the respective layers, whereby passage of an electric current through the respective dimethyl silicone rubber layers allows heating for dye supplement through diffusion.

The dye suppliers are each made of a porous foamed polyester having a dye therein. Each supplier is provided as covered with the respective recording medium, Thus, 5 mm thick dye layers 8Y, 8M and 8C are as shown in FIG. 3.

The printing film 11 includes a 6 μm thick PET film having a heat-resistant lubricating layer on one side thereof and a 6 μm thick image-receiving layer made of a polyester resin on the other side. The printing film 11 can be fed from a film roller 12 as desired.

In operation, the yellow dye layer 2Y of the medium 1 is first superposed on the printing film 11, followed by thermosensitive transfer recording by heating from the side of the printing film by means of a thermal head 6. This procedure is repeated for the magenta and cyan colors. The resultant film 11 is laminated on a mount to obtain a full color image. The image has an optical density of 2 for all the yellow, magenta and cyan dyes when determined by the Macbeth densitometer. When the transfer recording is repeated without supplementing dyes from the dye suppliers, the transfer sensitivity is lowered only at a rate of not larger than 10% after five cycles of the recording. This is because the respective dye layers of the medium are as thick as 500 μm.

After completion of the recording, the medium 1 whose concentrations of the respective dyes are partially lowered are regenerated in the following manner. The respective dye layers of the medium are heated by current passage, so that the dyes of the respective dye suppliers are diffused toward the respective dye layers, thereby regenerating the dye layers. As a result, the dye layers and the dye suppliers become equibrated with respect to the dye concentration. The transfer sensitivity after repetition is fully restored.

Comparative Example 2

The general procedure of Example was repeated using polyvinyl butyral resin instead of dimethyl silicone resin as the binder resin of the dye layers, thereby making a thermosensitive transfer recording medium. The medium is used for the thermosensitive transfer recording and the regeneration of the medium. As a result, it has been found that the dyes cannot be sufficiently diffused from the dye suppliers toward the dye layers of the medium by current passage to the medium at the time of the generation. The resultant image sensitivity becomes lower as the repetition cycle of the transfer recording is increased.

EXAMPLE 4

Figure 8:
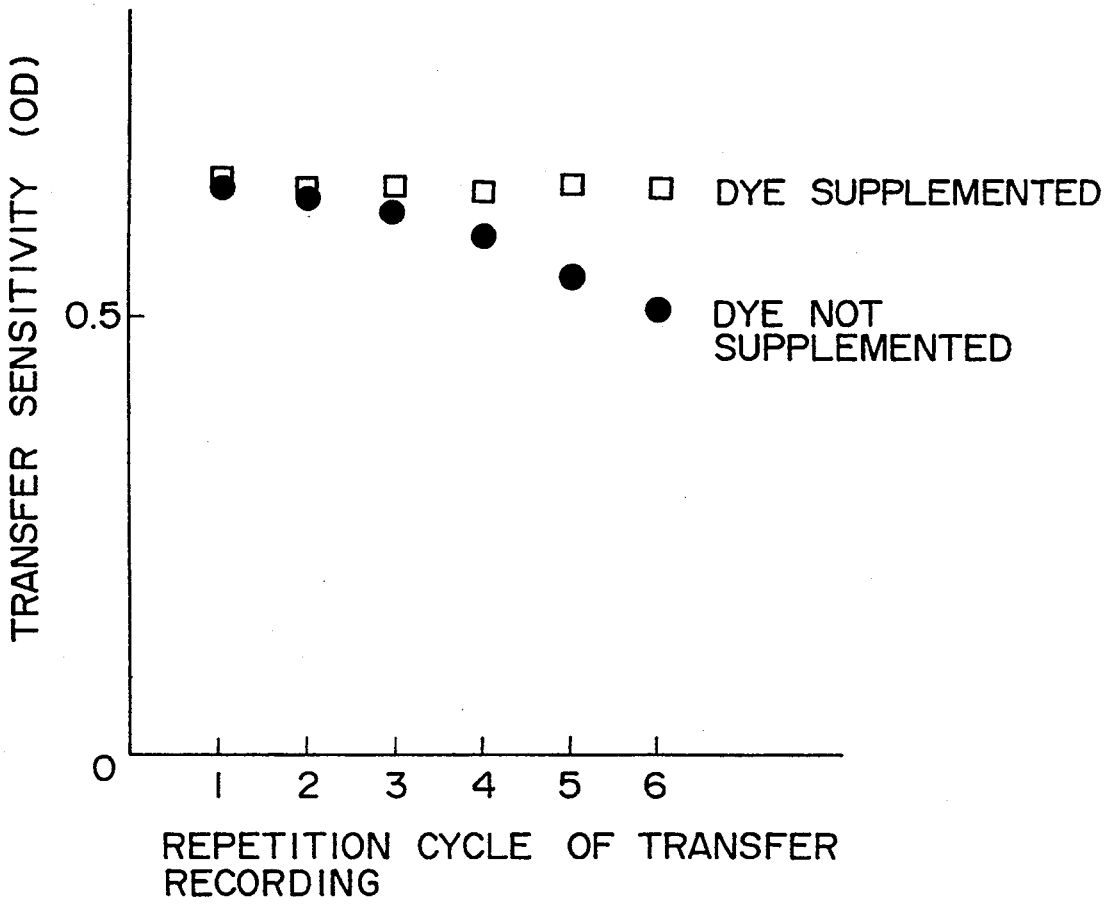
FIG. 8 is a graph showing the relation between the transfer sensitivity and the number of repetitions of a transfer cycle of a thermosensitive transfer recording medium of the invention.

A thermosensitive transfer recording medium having a 20 μm thick dye layer is made using a phenyl silicone resin as a binder resin and a yellow dye (ESC-155, available from Sumitomo Chem. Co., Ltd.). The medium is subjected to thermosensitive transfer recording while supplementing the dye and without supplementing the dye, followed by repetition of the transfer recording and measurement of a transfer sensitivity (optical density). The results are shown in Table below and in FIG. 8.

TABLE 1

| Repetition Cycle of Transfer Recording | Yellow (OD) Dye Supplemented | Dye Not Supplemented |
|---|---|---|
| 1 | 0.66 | 0.65 |
| 2 | 0.65 | 0.64 |
| 3 | 0.65 | 0.62 |
| 4 | 0.64 | 0.59 |
| 5 | 0.65 | 0.54 |
| 6 | 0.64 | 0.51 |

The above results reveal that the transfer medium of the invention can be fully restored when dyes are supplemented and that when the dye layer is formed as thick, it exhibits a remarkable buffering function of the dye whereby a certain level of transfer sensitivity after repetitions of the transfer recording is ensured without supplementing the dye.

In the foregoing examples, the thermosensitive transfer recording apparatus for carrying out the regeneration method of the medium are particularly described along with the thermosensitive transfer recording. The regeneration apparatus may be provided independently of the thermosensitive transfer recording apparatus.

What is claimed is:

1. A method for regenerating a thermosensitive transfer recording medium which comprises providing a thermosensitive transfer recording medium which comprises a dye layer containing a thermally diffusable dye which has been subjected to thermosensitive transfer recording so that the thermally diffusable dye is consumed during the recording operation, bringing said recording medium into contact with a dye supplier having a concentration of the dye higher than that of the dye layer, and diffusing the dye from the dye supplier toward said dye layer by heating thereby supplementing the dye in said dye layer.

2. A method according to claim 1, wherein said dye layer further comprises conductive particles dispersed therein whereby said dye layer is heated by current passage therethrough.

3. A method according to claim 1, wherein said recording medium is in the form of an endless belt and is divided into three sections having different dye layers whereby each dye layer is regenerated by repeating the procedure defined in claim 1.

* * * * *